US008944841B2

(12) United States Patent
YuQiang et al.

(10) Patent No.: US 8,944,841 B2
(45) Date of Patent: Feb. 3, 2015

(54) ELECTRICAL CONNECTOR HAVING INTEGRATED GUIDE ELEMENT

(71) Applicants: Tyco Electronics Corporation, Berwyn, PA (US); Tyco Electronics (Shanghai) Co., Ltd., Shanghai (CN)

(72) Inventors: Zhao YuQiang, Shanghai (CN); Robert Paul Nichols, Vacaville, CA (US); Zhao Guangming, Shanghai (CN); Michael Allen Blanchfield, Camp Hill, PA (US)

(73) Assignees: Tyco Electronics Corporation, Berwyn, PA (US); Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 13/922,705

(22) Filed: Jun. 20, 2013

(65) Prior Publication Data

US 2014/0302706 A1 Oct. 9, 2014

(51) Int. Cl.
*H01R 13/64* (2006.01)

(52) U.S. Cl.
CPC ..... *H01R 13/64* (2013.01)
USPC ..... 439/378

(58) Field of Classification Search
USPC ..... 439/378, 947, 680, 681
See application file for complete search history.

(56) References Cited

U.S. PATENT DOCUMENTS 4,934,950 A * 6/1990 Green et al. ..... 439/681
5,080,604 A * 1/1992 Rider et al. ..... 439/357
5,830,001 A * 11/1998 Kinoshita et al. ..... 439/354
6,402,549 B1 * 6/2002 Ayres et al. ..... 439/578
6,565,392 B2 5/2003 Padro
6,672,884 B1 * 1/2004 Toh et al. ..... 439/79
6,890,214 B2 5/2005 Brown et al.
7,065,871 B2 6/2006 Minich et al.
7,186,121 B1 3/2007 Costello et al.
7,527,533 B2 5/2009 Lappoehn
7,780,483 B1 8/2010 Ravlich
7,997,938 B2 8/2011 Costello et al.
8,002,559 B2 8/2011 Thiel et al.
2005/0197018 A1 * 9/2005 Lord ..... 439/680
2013/0252477 A1 * 9/2013 Mcalonis et al. ..... 439/680

OTHER PUBLICATIONS 1469921-1 MiniPak HD Power-Signal Connector (Sep. 2008).
EXTreme Ten60Power Hybrid Power and Signal Connectors (2011).
Minipak High-Density Board-to-Board Power Connectors, Tyco Electronics (2010).
Molex Extreme Power Products Catalog (downloaded Feb. 6, 2013).
(Continued)

*Primary Examiner* — Phuong Dinh

(57) ABSTRACT

Electrical connector including a connector housing having a mating side facing in a mating direction along an engagement axis. The mating side extends along a lateral axis and an orientation axis that are perpendicular to each other and the engagement axis. The connector housing also includes first and second end sides facing in opposite directions along the lateral axis and a top side facing in a direction along the orientation axis. The top side extends between the first and second end sides and is substantially planar from the first end side to the second end side. The electrical connector also includes first and second mating regions that are defined by the first and second end sides, respectively. Each of the first and second mating regions includes electrical contacts and a guide feature, wherein at least some of the electrical contacts and the guide feature are aligned with one another.

20 Claims, 7 Drawing Sheets

(56) References Cited

OTHER PUBLICATIONS

Molex Power Connectors Catalog (partial) (downloaded Feb. 6, 2013).
Multi-Beam XL and Multi-Beam XLE Power Distribution Connector Systems (2010).
Multi-Beam XL Connectors (Apr. 6, 2011).
Product Specification for Ten60Power Board to Board Interconnect Systems (Aug. 2011).
SD-46436-1080 Molex Ten60 Power Receptacle (Jul. 2009).
SD-46562-1171 Molex Ten60 Vertical Receptacle (Nov. 2010).
Solutions for AdvancedTCA, AdvancedTCA 300, MicroTCA, and AdvancedMC Standards, Tyco Electronics (2007).

* cited by examiner

ELECTRICAL CONNECTOR HAVING INTEGRATED GUIDE ELEMENT

CROSS-REFERENCE TO RELATED APPLICATION

The present application claims the benefit of Chinese Patent Application No. 201310118559.X, filed on Apr. 8, 2013, which is incorporated herein by reference in its entirety.

BACKGROUND

The subject matter herein relates generally to an electrical connector that has a guide element to facilitate mating with another electrical connector.

In some communication systems, an electrical connector is mounted along a leading edge of a circuit board to form a circuit board assembly. The electrical connector may be capable of transmitting electrical power, data signals, or both electrical power and data signals from and/or to the circuit board. The electrical connector includes a mating side that faces away from the leading edge and has electrical contacts arranged therealong. The electrical contacts engage corresponding electrical contacts during a mating operation.

During the mating operation, the circuit board assembly may be advanced in an insertion direction toward another electrical component. The electrical component that mates with the electrical connector may be, for example, an electrical connector of another circuit board assembly or of a backplane assembly. The mating side of the electrical connector faces in the insertion direction. Such circuit board assemblies typically include a guide mechanism that aligns the electrical connectors during the mating operation. For example, a guide post or pin of one electrical connector may extend in the insertion direction and may be inserted into a guide cavity of the other electrical connector.

Although the electrical connectors may operate suitably for transmitting electrical current, the electrical connectors described above may have certain limitations that render them unsuitable or undesirable for some applications. For instance, the arrangement of the electrical contacts and the guide mechanism(s) may limit the available space along the leading edge of the circuit board. More specifically, known electrical connectors include two guide cavities that are located at opposite sides of the electrical connector with the electrical contacts located directly between the guide cavities. The guide cavities and the electrical contacts are at a common height or level along the mating side. As such, space along the leading edge that may otherwise be occupied by additional electrical contacts is, instead, occupied by the guide cavities.

Accordingly, there is a need for an electrical connector that is capable of suitably aligning with another connector while permitting a greater number or density of electrical contacts than known electrical connectors.

BRIEF DESCRIPTION

In one embodiment, an electrical connector is provided that includes a connector housing positioned with respect to an engagement axis, a lateral axis, and an orientation axis that are mutually perpendicular with one another. The connector housing includes a mating side that faces in a mating direction along the engagement axis and is configured to engage an electrical component during a mating operation. The mating side extends along the lateral axis and the orientation axis. The connector housing also includes first and second end sides facing in opposite directions along the lateral axis. The connector housing also includes a top side facing in a direction along the orientation axis. The top side extends between the first and second end sides and is substantially planar from the first end side to the second end side. The electrical connector includes first and second mating regions. The first and second mating regions are defined by the first and second end sides, respectively. Each of the first and second mating regions includes electrical contacts and a guide feature that are disposed along the mating side and configured to engage the electrical component, wherein at least some of the electrical contacts and the guide feature are aligned with one another along the orientation axis.

In another embodiment, an electrical connector is provided that has a connector housing positioned with respect to an engagement axis, a lateral axis, and an orientation axis that are mutually perpendicular with one another. The connector housing includes a mating side that faces in a mating direction along the engagement axis and is configured to engage an electrical component during a mating operation. The mating side extends along the lateral axis and the orientation axis. The connector housing also includes first and second end sides facing in opposite directions along the lateral axis and a top side facing in a direction along the orientation axis. The top side extends between the first and second end sides. The connector housing also includes a mounting side that is opposite the top side. The electrical connector includes first and second mating regions. The first and second mating regions are defined by the first and second end sides, respectively. Each of the first and second mating regions includes electrical contacts and a guide feature that are disposed along the mating side and configured to engage the electrical component. At least some of the electrical contacts and the guide feature for each of the first and second mating regions are aligned with one another along the orientation axis. The electrical contacts of the first mating region form a first array, wherein (i) the first array is located between the first guide feature and the mounting side or (ii) the first guide feature is located between the first array and the mounting side.

DETAILED DESCRIPTION

Figure 1:
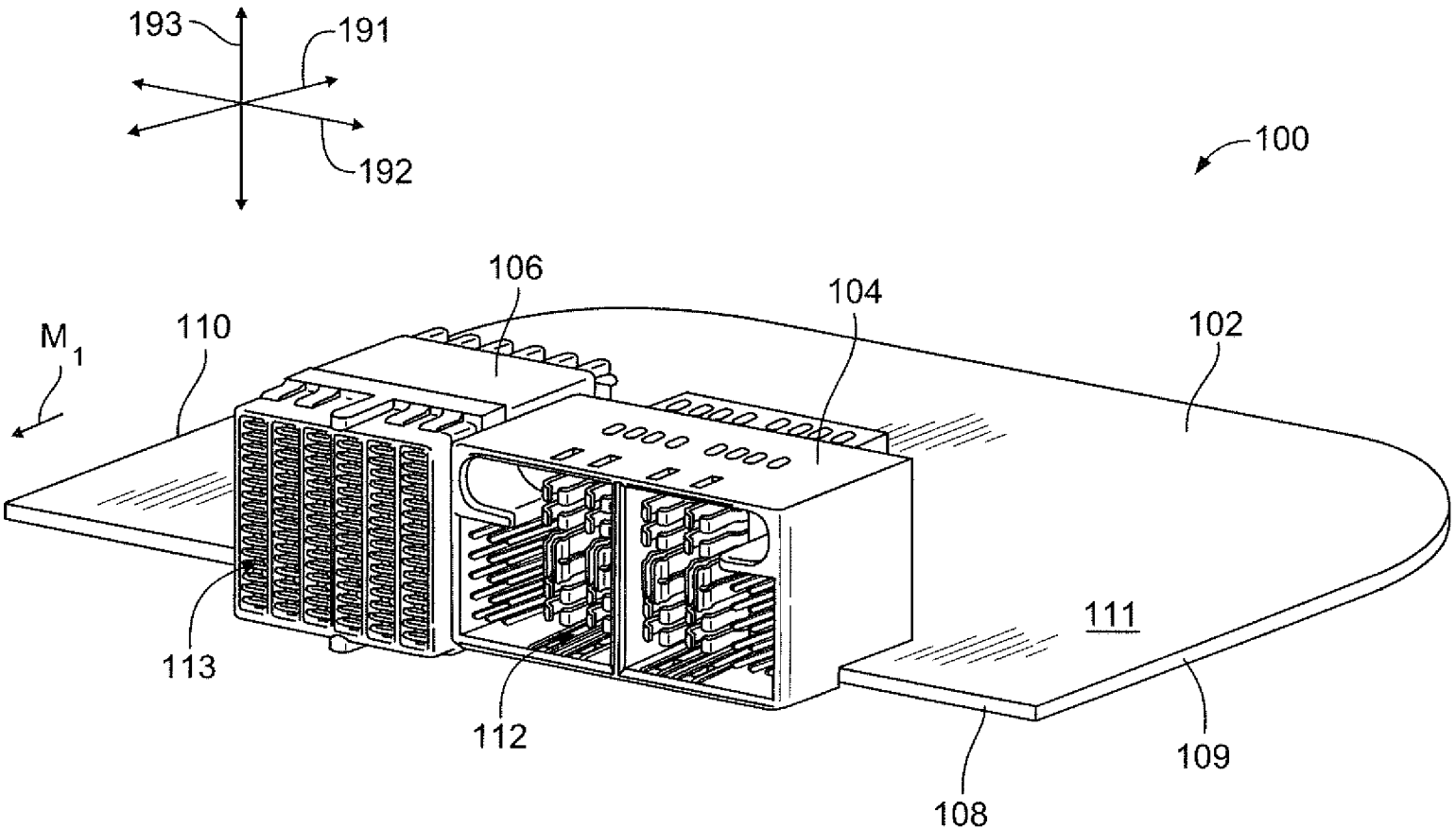
FIG. 1 is a perspective view of a circuit board assembly formed in accordance with one embodiment.

Embodiments described herein may include electrical connectors having electrical contacts and at least one guide feature. The electrical contacts may be configured for transmitting data signals (hereinafter referred to as electrical contacts) or configured for transmitting electrical power (hereinafter referred to as power contacts). In some embodiments, the electrical connectors may be positioned along a leading edge of a circuit board and face in a direction that is parallel to a plane defined by the circuit board. Such electrical connectors may be referred to as right-angle receptacle assemblies or right-angle header assemblies. In other embodiments, the electrical connectors may face away from a board surface such that the electrical connector faces in a direction that is perpendicular to the plane of the circuit board. Such electrical connectors may be referred to as vertical receptacle assemblies or vertical header assemblies.

The electrical contacts and guide feature(s) may be arranged to permit a greater number or density of contacts than known electrical connectors. As used herein, a guide feature is a structure of the electrical connector that is designated to interact with a complementary structure of a mating connector (e.g., another electrical connector) to align the electrical connector and the mating connector so that the electrical contacts are suitably engaged. By way of example, the guide features may be a guide projection or a guide module. The guide module has a cavity that is sized and shaped to receive the guide projection. As used herein, the term "guide module" includes a cavity that receives the projection and also surfaces that define the cavity. During a mating operation, the guide projection may engage the surfaces that define the cavity.

Electrical connectors described herein may have more lateral space for positioning the electrical contacts or adding new contacts without increasing the width of the electrical connector. For instance, in some embodiments, the electrical connector has a mating side that faces in a mating direction along an engagement axis. The mating side is defined between to end sides of the electrical connector. The electrical contacts may be distributed along the mating side from one end side of the connector to the other end side. The guide features may be aligned with the electrical contacts along an orientation axis (or vertical axis) that is perpendicular to the engagement axis. As used herein, a guide feature and an electrical contact are aligned with each other along the orientation axis if a plane that extends parallel to the orientation and engagement axes intersects the electrical contact and at least a portion of the guide feature. In some embodiments, the guide features are located above at least some of the electrical contacts such that the electrical contacts are located between the guide features and the circuit board. In other embodiments, the guide features are located below at least some of the electrical contacts such that the guide features are located between the at least some electrical contacts and the circuit board. In particular embodiments, the electrical contacts aligned with the guide features are signal contacts.

Embodiments may have a planar or flat top side that extends over the guide features and electrical contacts unlike known electrical connectors. The planar top side may allow manufacturers to use a common tool for mounting the electrical connector to the circuit board. Optionally, embodiments may utilize a mounting projection that directly couples the electrical connector to the circuit board without the use of additional hardware (e.g., mounting screws).

FIG. 1 is a perspective view of a circuit board assembly 100 formed in accordance with one embodiment. As shown, the circuit board assembly 100 is oriented with respect to mutually perpendicular axes 191-193, which include an engagement or mating axis 191, a lateral axis 192, and an orientation or mounting axis 193. The circuit board assembly 100 may include a circuit board 102 and an electrical connector 104 mounted thereto. The circuit board assembly 100 may also include other components, such as an electrical connector 106 or separate guide mechanisms (not shown) that are directly coupled to the circuit board 102. The circuit board 102 has side edges 109, 110 that extend along the engagement axis 191 and a leading edge 108 that extends between the side edges 109, 110 along the lateral axis 192. The circuit board 102 has a board surface 111 that has the electrical connector 104 and the electrical connector 106 mounted thereto. The electrical connector 104 is configured to engage (e.g., mate with) a complementary electrical connector, such as the electrical connector 204 shown in FIG. 7.

The circuit board assembly 100 may be used in various applications. By way of example, the circuit board assembly 100 may be used in telecom and computer applications, routers, servers, supercomputers, and uninterruptible power supply (UPS) systems. In one embodiment, the circuit board assembly 100 is part of a backplane system or assembly that includes a backplane circuit board (not shown) that extends orthogonal to the circuit board 102 during operation. In such embodiments, the circuit board assembly 100 may be described as a daughter card assembly. In another embodiment, the circuit board assembly 100 may be configured to mate with a complementary circuit board assembly (not shown) that has a mating connector. The circuit boards may be substantially edge-to-edge after the mating operation and have the connectors extending between the opposing edges. Thus, the two circuit boards may be electrically coupled to each other through the mated electrical connectors. In such embodiments, the electrical connectors may be described as board-to-board connectors.

In particular embodiments, the electrical connector 104 may be similar to connectors in the MINIPAK HD power connector product line or the MULTI-BEAM XL connector product line developed by TE Connectivity that are capable of transmitting electrical power and data. On the other hand, the electrical connector 106 may be exclusively dedicated or primarily dedicated to transmitting data. For example, the electrical connector 106 may be similar to connectors in the STRADA Whisper or Z-PACK TinMan product lines also developed by TE Connectivity. In some embodiments, the electrical connector 106 is capable of transmitting data signals at high speeds, such as 10 Gbps, 20 Gbps, or more.

The electrical connectors 104, 106 have respective mating sides 112, 113 that face in a mating direction $M_1$ along the engagement axis 191. During a mating operation, the mating sides 112, 113 are oriented to face other electrical components (not shown), such as mating connectors mounted on a backplane or other circuit board, bus bar, or any combination of the two.

Figure 2:
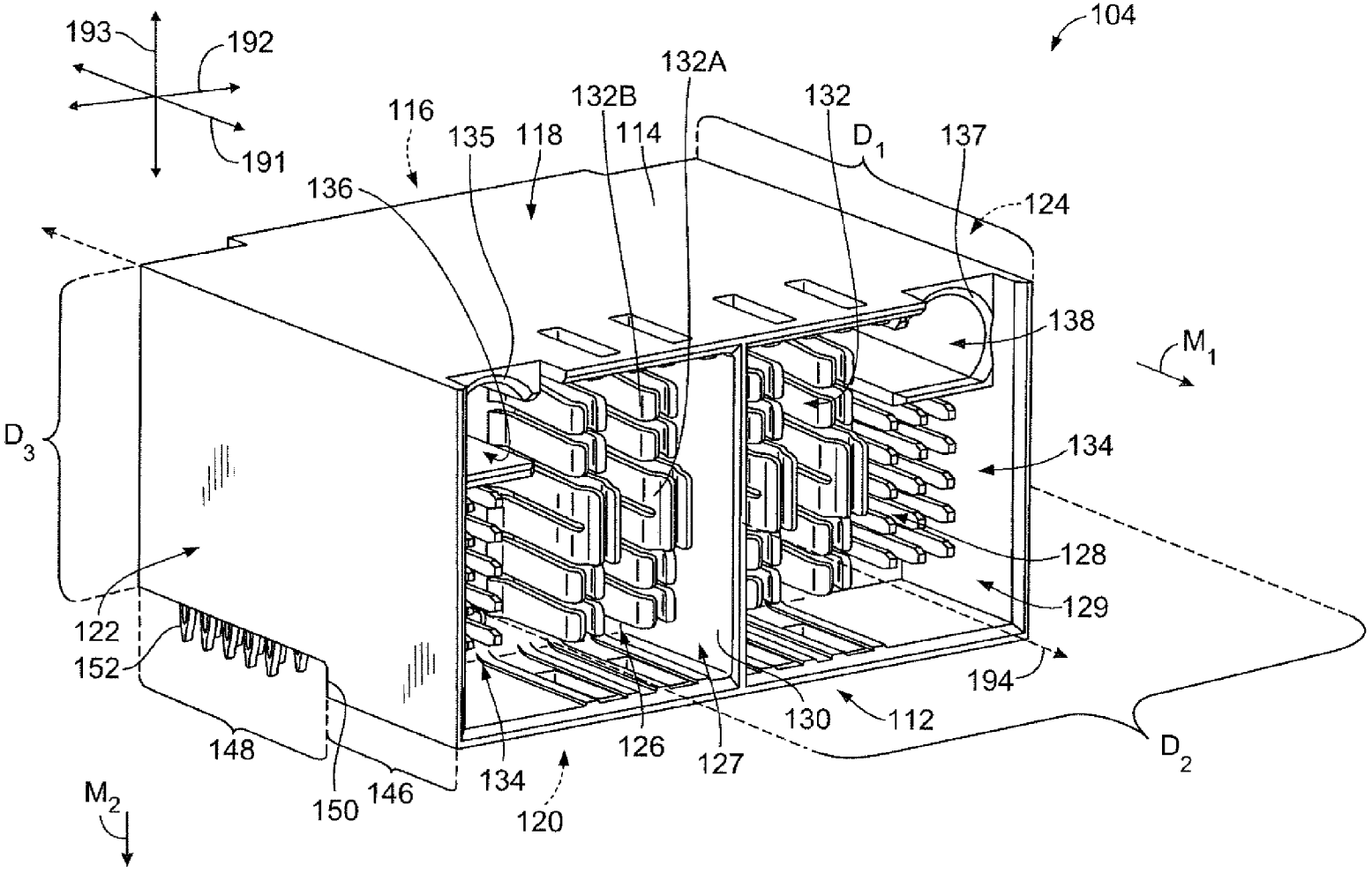
FIG. 2 is an isolated perspective view of an electrical connector formed in accordance with one embodiment that may be used with the circuit board assembly of FIG. 1.

FIG. 2 is an isolated perspective view of the electrical connector 104. The electrical connector 104 includes a connector housing 114 that has the mating side 112 and a back side 116 in which the mating and back sides 112, 116 face in opposite directions along the engagement axis 191. As shown in FIG. 2, a central axis 194 extends between the mating and back sides 112, 116. The central axis 194 extends parallel to the engagement axis 191. The connector housing 114 also includes a top side 118 and a mounting side 120, which face in opposite directions along the orientation axis 193, and first and second end sides 122, 124, which face in opposite directions along the lateral axis 192. The mating and back sides 112, 116, the mounting and top sides 120, 118, and the end sides 122, 124 may represent exterior sides of the connector housing 114. In the illustrated embodiment, the connector housing 114 is generally block-shaped. However, alternative configurations may be used in other embodiments.

As used herein, spatially relative terms, such as "front", "back", "top," "above," "below," and the like, are used herein for ease of description to distinguish one element or feature from another. Such terms are used with reference to the electrical connector 104 having an orientation as shown in FIGS. 1-6 in which the orientation axis 193 extends parallel to the direction of gravity. It will be understood, however, that such spatially relative terms may encompass different orientations of the connector (or its components) in use or operation. More specifically, if the orientation axis 193 extends parallel to the direction of gravity as shown in FIG. 2, then the top side 118 is above the other sides. However, if the electrical connector 104 as shown in FIG. 2 was turned 90° clockwise about the central axis 194 such that the lateral axis 192 extends parallel to the direction of gravity, then the top side 118 would be lower than the end side 122. Accordingly, the term "top" can encompass both an orientation in which the top side 118 is located above other sides or below at least one side. Likewise, other spatially relative terms are not intended to limit the described embodiment to the orientation shown in FIG. 2 or other figures.

In the illustrated embodiment, the connector housing 114 may have dimensions that are measured along the axes 191-193. The dimensions include a first dimension $D_1$ that is measured along the engagement axis 191, a second dimension $D_2$ that is measured along the lateral axis 192, and a third dimension $D_3$ that is measured along the orientation axis 193. The dimensions $D_1$, $D_2$, and $D_3$ may be referred to, respectively, as a length of the connector housing 114, a width of the connector housing 114, and a height of the connector housing 114. In the illustrated embodiment, the width $D_2$ is greater than the length $D_1$ and the height $D_3$. In other embodiments, either or both of the length $D_1$ and height $D_3$ may be greater than the width $D_2$.

The connector housing 114 may have a plurality of contact cavities that open to the mating side 112. In other words, the contact cavities may be accessed through the mating side 112. For example, the connector housing 114 may include first and second contact cavities 126, 128 that are separated by an internal wall or divider 130. The internal wall 130 is located approximately halfway along the width $D_2$, but may have different locations in other embodiments (e.g., ⅓ or ⅔ along the width $D_2$). In alternative embodiments, the internal wall 130 may not be located between and separate the contact cavities 126, 128 and, instead, the connector housing 114 may include a single contact cavity that opens to the mating side 112.

Each of the contact cavities 126, 128 has a cavity opening 127, 129, respectively, at the mating side 112. Each of the contact cavities 126, 128 may include electrical contacts 132, 134 disposed therein. The electrical contacts 132 may be dimensioned for transmitting electrical power and, thus, may be referred to as power contacts. The electrical contacts 134 may be dimensioned for transmitting data signals and, thus, may be referred to as signal contacts. As such, the electrical contacts 132 may be sized and shaped to be larger than the electrical contacts 134. For example, the electrical contacts 132 may have a greater thickness than a thickness of the electrical contacts 134.

In some embodiments, the electrical contacts 132 may have different lengths and/or contours with respect to each other. For example, in FIG. 2, an end of the electrical contact 132A may be closer to the cavity opening 127 than an end of the electrical contact 132B. Although not shown, the electrical contacts 134 may also have different lengths and/or contours.

The connector housing 114 may also include first and second guide features 135, 137. In the illustrated embodiment, the guide features are guide modules having cavities that extend along the engagement axis 191 and, as such, will hereinafter be referred to as guide modules. The guide modules 135, 137 have cavities 136, 138, respectively, that are sized and shaped to receive and direct a complementary guide projection from, for example, the electrical connector 204 (shown in FIG. 7). The cavity 136 opens to the mating side 112 and also to the contact cavity 126 within the connector housing 114. Accordingly, the cavity 136 and the contact cavity 126 may be part of a single cavity. In such embodiments, the cavity 136 may be referred to as a guide portion of the contact cavity 126. Likewise, the cavity 138 opens to the mating side 112 and also to the contact cavity 128 within the connector housing 114. The cavity 138 and the contact cavity 128 may be considered part of a single cavity and, in some embodiments, the cavity 138 may be referred to as a guide portion of the contact cavity 128.

The mating side 112 extends along the lateral axis 192 and the orientation axis 193 and faces in the mating direction $M_1$ along the engagement axis 191. The mating side 112 is configured to engage an electrical component during the mating operation, such as the electrical connector 204 shown in FIG. 7. The electrical connector 204 may have complementary features for engaging the electrical connector 104. During the mating operation, the electrical connector 104 may be moved toward the electrical connector 204 and/or the electrical connector 204 may be moved toward the electrical connector 104.

In FIG. 2, the mounting side 120 is configured to be mounted along the leading edge 108 (FIG. 1) of the circuit board 102 (FIG. 1). As shown, the mounting side 120 may include an overhang portion 146 and an interface portion 148 that are joined by an edge-facing wall 150. The edge-facing wall 150 extends along the orientation axis 193 and the lateral axis 192 and faces toward the back side 116. In operation, the leading edge 108 is configured to interface with and extend along the edge-facing wall 150. For instance, the leading edge 108 may engage or be located proximate to the edge-facing wall 150. As such, the overhang portion 146 may clear and be located in front of the leading edge 108. The interface portion 148 is configured to be mounted directly onto and interface with the board surface 111 (FIG. 1).

As shown, the electrical connector 104 may have a plurality of contact tails 152 that project from the interface portion 148 in a mounting direction $M_2$ along the orientation axis 193. The contact tails 152 in FIG. 2 are part of the electrical contacts 134. Similarly, the electrical contacts 132 may have contact tails 154 (shown in FIG. 3) that project from the interface portion 148 of the mounting side 120. The contact tails 152, 154 may have compliant or press-fit structures that are configured to engage and be deformed by corresponding plated thru-holes (PTHs) (not shown) of the circuit board 102. As such, the contact tails 152, 154 may mechanically and electrically engage the corresponding PTHs. The contact tails 152, 154 may remain electrically engaged to the PTHs during operation through a frictional engagement (e.g., interference fit).

Figure 3:
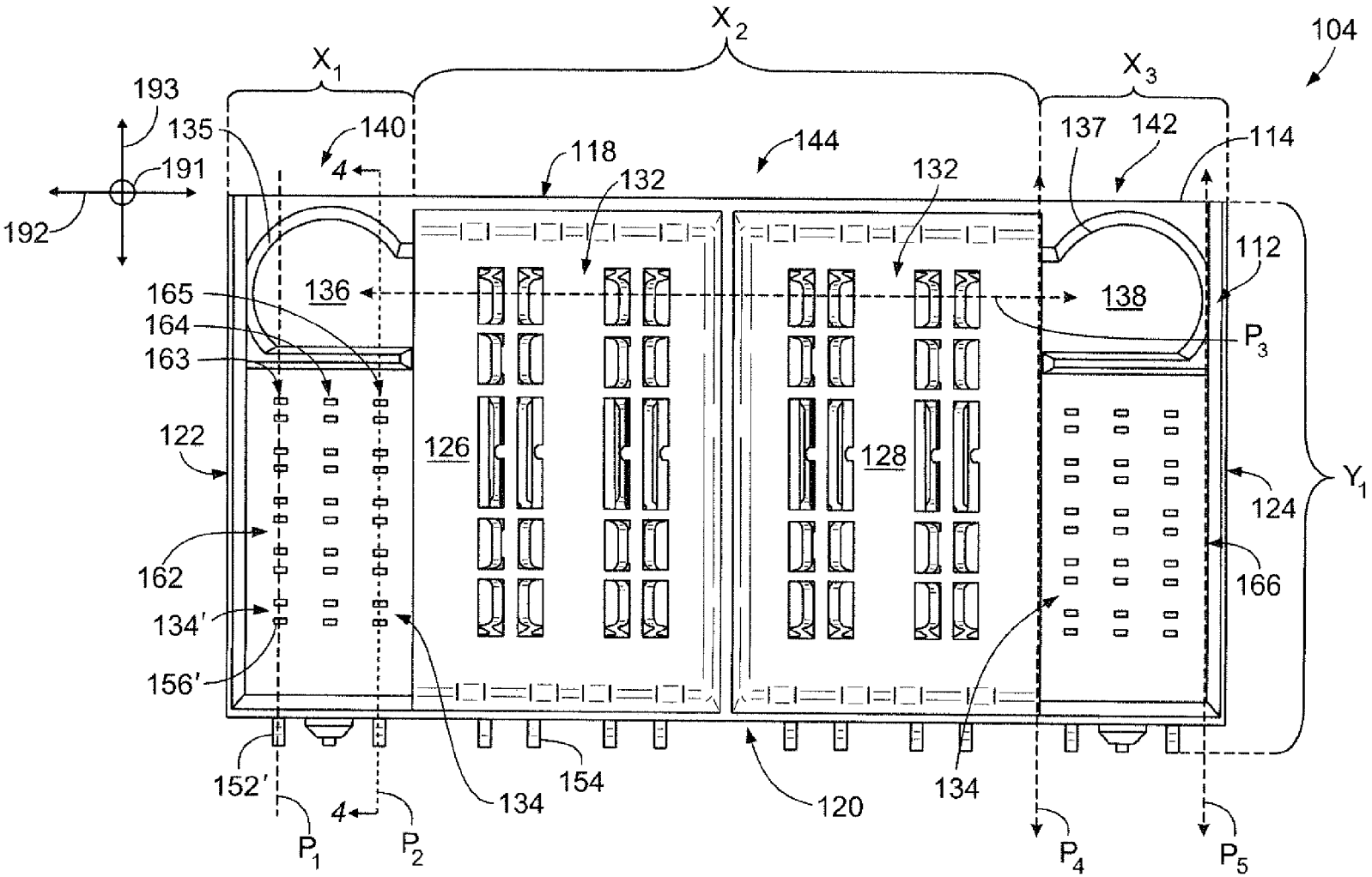
FIG. 3 is a front-end view of the electrical connector that may be used with the circuit board assembly of FIG. 1.

FIG. 3 is a front end view of the electrical connector 104. As shown, each of the contact cavities 126, 128 may have a plurality of the electrical contacts 132 and a plurality of the electrical contacts 134. The electrical contacts 132, 134 may be collectively exposed within the corresponding contact cavity. Alternatively, one or more of the electrical contacts 132, 134 may be isolated within a corresponding socket cavity.

Figure 7:
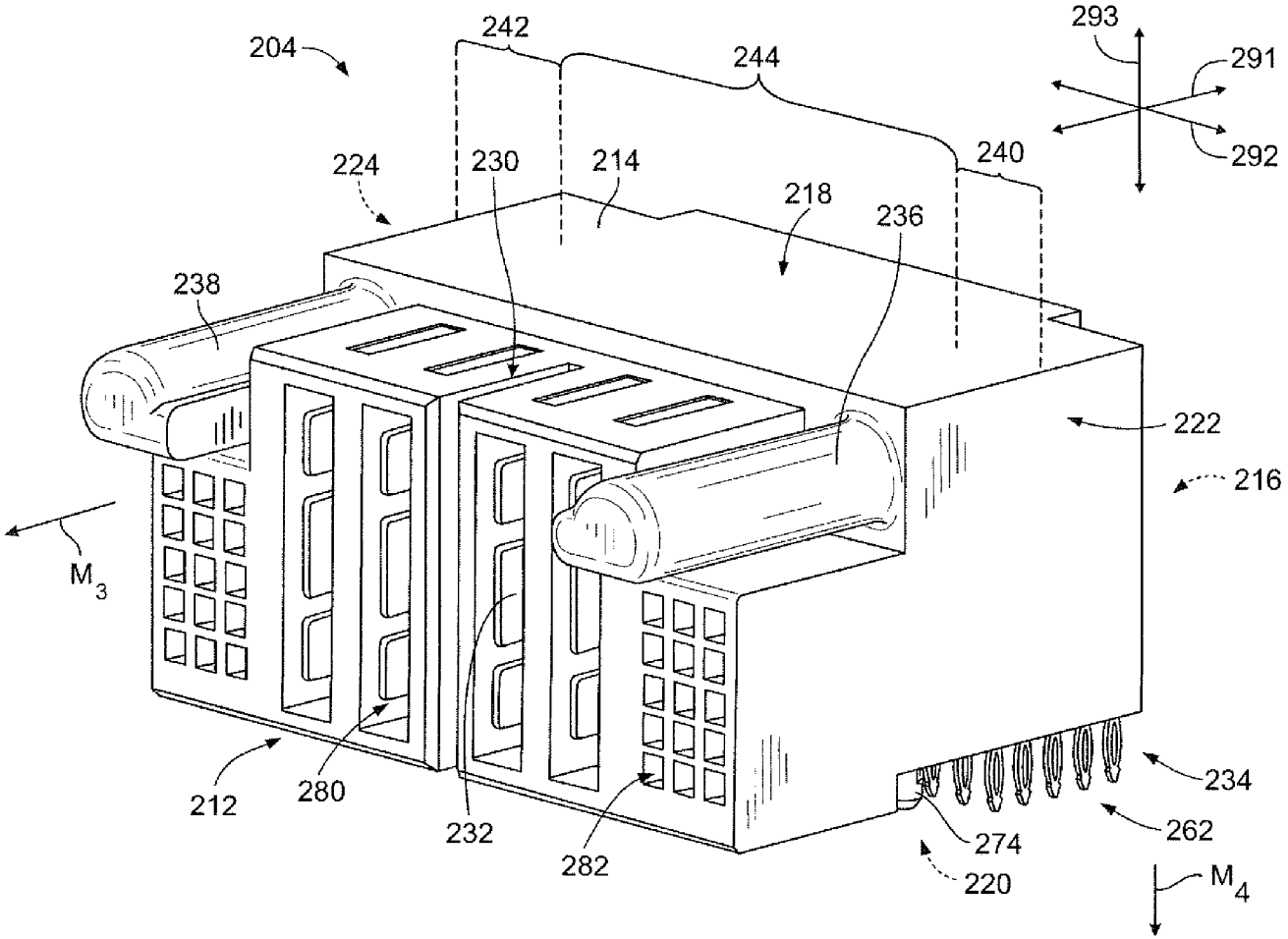
FIG. 7 is an isolated perspective view of an electrical connector formed in accordance with one embodiment that may engage the electrical connector of FIG. 2 during a mating operation.

Optionally, the electrical contacts 132, 134 may be substantially planar. For instance, conductor paths 160 (shown in FIG. 4) of the electrical contacts 134 may extend through the connector housing 114 and reside in a common plane. By way of one example, FIG. 3 shows a single electrical contact 134'. The electrical contact 134' has an exposed mating portion 156' within the contact cavity 126 that is configured to engage an electrical contact 234 (shown in FIG. 7) of the electrical connector 204 (FIG. 7). The electrical contact 134' also has a contact tail 152' that projects from the mounting side 120. The mating portion 156' and the contact tail 152' are located and extend within a contact plane $P_1$. The contact plane $P_1$ may extend parallel to a plane defined by the orientation axis 193 and the engagement axis 191. In a similar manner, each of the electrical contacts 132 may extend along a plane that is parallel to the contact plane $P_1$ and the plane defined by the orientation axis 193 and the engagement axis 191. In alternative embodiments, the electrical contacts 132, 134 are not planar such that the conductor paths 160 do not reside in a common plane.

As shown, the electrical contacts 132, 134 may be disposed in the contact cavities 126, 128 along designated lateral regions or portions of the connector housing 114. For example, the connector housing 114 may include first and second mating regions 140, 142 and a center region 144 that extends between the mating regions 140, 142 along the lateral axis 192. The mating regions 140, 142 may be defined by the end sides 122, 124, respectively. Although only one center region 144 is shown in FIG. 3, the mating side 112 may have more than one center region located between the mating regions 140, 142 in other embodiments.

The mating regions 140, 142 include the end sides 122, 124, respectively, and extend a depth into the connector housing 114 from the corresponding end side. For example, each of the mating regions 140, 142 extends along the lateral axis 192 for a lateral distance. As shown in FIG. 3, the mating region 140 extends from the end side 122 a lateral distance $X_1$. The mating region 142 extends from the end side 124 a lateral distance $X_2$. The center region 144 extends between the mating regions 140, 142 along the lateral axis 192 for a lateral distance $X_3$. As shown, the lateral distance $X_3$ is at least three times (3X) greater than the lateral distance $X_1$ or the lateral distance $X_2$. In some embodiments, each of the mating regions 140, 142 and the center region 144 extends along the orientation axis 193 for a common vertical distance $Y_1$.

In some embodiments, the top side 118 is substantially planar and extends from the end side 122 to the end side 124 (e.g., starting from the end side 122 and extending up to the end side 124). As used herein, a side is "substantially planar" if at least 75% of an area of the side is co-planar (e.g., lies or resides within a common plane) while the remaining portion of the area extends into the electrical connector (e.g., toward the central axis 194 (FIG. 2)). More specifically, the remaining portion may not project outwardly from the corresponding side. In some embodiments, at least 80% of the area lies within the common plane or, more particularly, at least 90% or 95% of the area lies within the common plane. In the illustrated embodiment, the common plane extends parallel to a plane defined by the engagement axis 191 and the lateral axis 192. In such embodiments, a single type of seating tool may be used to mount the electrical connector 104. For example, a tool may press against the top side 118 to press the contact tails 152, 154 into the circuit board 102. This is unlike known electrical connectors that have a non-planar top side that requires a special type of seating tool.

The end sides 122, 124, the top side 118, and the mounting side 120 may define a perimeter of the mating side 112. In certain embodiments, the perimeter of the mating side 112 is rectangular as shown in FIG. 3. However, in other embodiments, the perimeter may be another polygonal shape or include one or more edges that are curved. For example, the end sides 122, 124 may bow outward.

In particular embodiments, the electrical contacts 132 may be power contacts that are positioned only in the center region 144 of the mating side 112, and the electrical contacts 134 may be signal contacts that are positioned only in the mating regions 140, 142. In alternative embodiments, the mating regions 140, 142 and/or the center region 144 may include both types of contacts. In other alternative embodiments, the electrical connector 104 may include only signal contacts or only power contacts. The guide modules 135, 137 and the corresponding cavities 136, 138 are located in the mating regions 140, 142, respectively. In some embodiments, at least some of the electrical contacts 132 are located directly between the cavities 136, 138 such that a plane $P_3$ extending parallel to the mounting side 120 may intersect each of the cavities 136, 138 and at least some of the electrical contacts 132.

In one or more embodiments, the cavity 136 and at least some of the electrical contacts 134 of the mating region 140 may be aligned with one another along the orientation axis 193. Likewise, in one or more embodiments, the cavity 138 and at least some of the electrical contacts 134 of the mating region 142 may be aligned with one another along the orientation axis 193. As used herein, a cavity of a guide module and an electrical contact are aligned with each other along the orientation axis 193 if a plane that extends parallel to the engagement and orientation axes 191, 193 intersects the electrical contact and at least a portion of the cavity.

As shown in FIG. 3, at least some of the electrical contacts 134 of the mating region 140 are located between the cavity 136 and the mounting side 120 and at least some of the electrical contacts 134 of the mating region 142 are located between the cavity 138 and the mounting side 120. The electrical contacts 134 in the mating region 140 may form a first array 162. Optionally, the array 162 may include at least two columns of electrical contacts 134 that extend between the mounting side 120 and the top side 118 along the orientation axis 193. For example, the electrical contacts 134 in the mating region 140 are arranged in three columns 163-165. Each of the columns 163-165 may have five (5) electrical contacts for a total of fifteen (15) electrical contacts in the mating region 140. As shown in FIG. 3, the column 163 extends along the contact plane $P_1$ and the column 165 extends along a contact plane $P_2$. Each of the contact planes $P_1$, $P_2$ may intersect the cavity 136. Although not shown, the column 164 also extends along a contact plane that intersects the cavity 136. Accordingly, in some embodiments, each and every electrical contact 134 of the first array 162 may be aligned with the cavity 136 along the orientation axis 193. The mating region 142 may have a second array 166 of electrical contacts 134 that are arranged similarly to the electrical contacts 134 in the array 162.

As shown in FIG. 3, a width of the cavity 138 is defined between planes $P_4$ and $P_5$ that extend parallel to the orientation and engagement axes 193, 191. The entire array 166 of electrical contacts 134 may be located between the planes $P_4$, $P_5$ without the planes $P_4$, $P_5$ intersecting the electrical contacts 134. Accordingly, the mating regions 140, 142 may include an entire array of electrical contacts that is located between the respective cavity 136 or 138 and the mounting side 120. However, in alternative embodiments, only some of the electrical contacts 134 are located between the corresponding cavity and the mounting side 120. For example, the column 163 and/or the column 165 may extend along a contact plane that does not intersect the cavity 136.

By locating the guide modules 135, 137 and the corresponding cavities 136, 138 in the mating regions 140, 142, respectively, and above or below the respective electrical contacts 134, the electrical connector 104 may utilize less lateral space than other known connectors. As such, a total number and/or density of electrical contacts may be increased while still providing an effective means of aligning the electrical connector 104 with the electrical connector 204 (FIG. 7).

Figure 4:
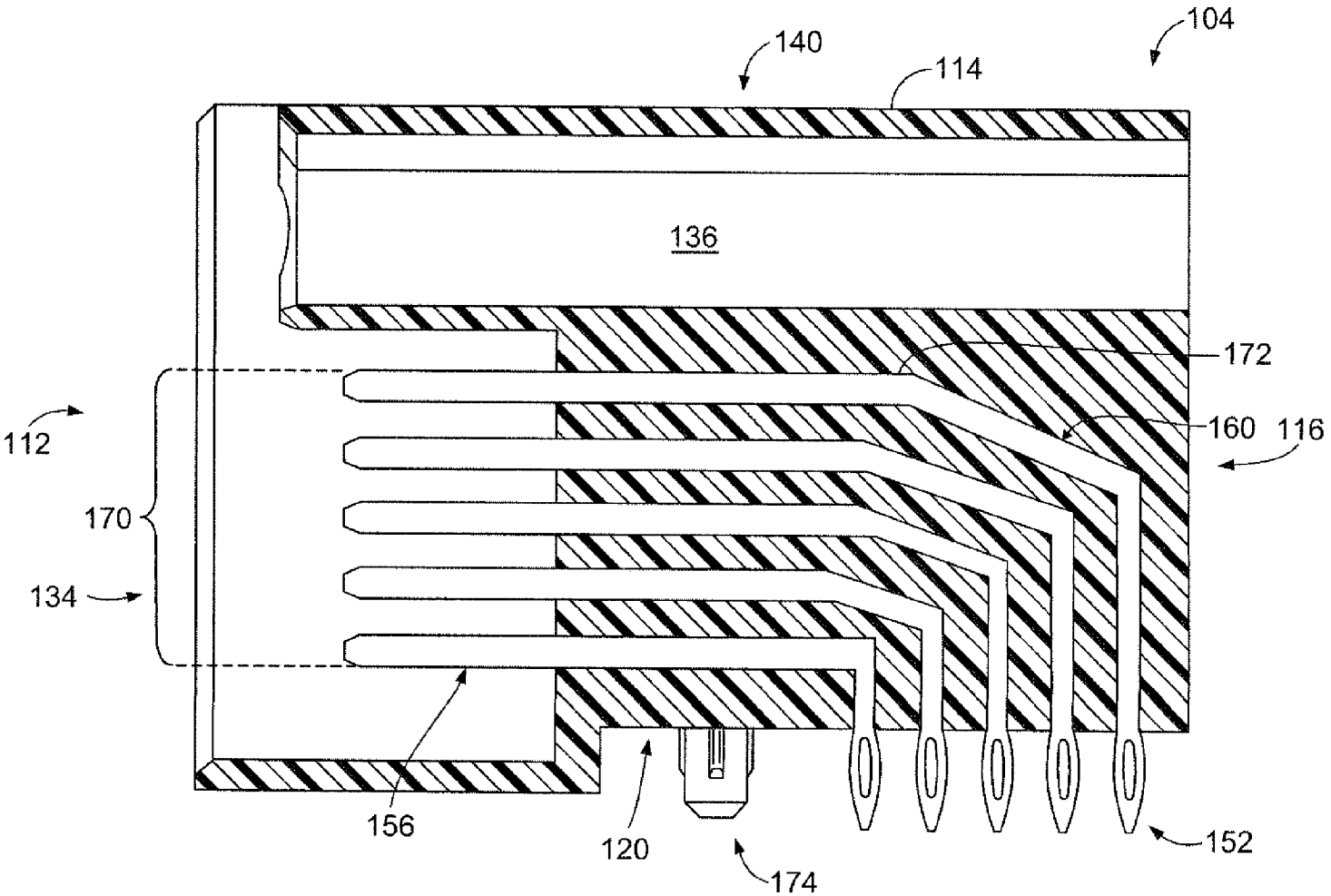
FIG. 4 is a side cross-section of the electrical connector taken along the line 4-4 shown in FIG. 3.

FIG. 4 is a side cross-section of the electrical connector 104 taken along the line 4-4 in FIG. 3 or, more specifically, the contact plane $P_2$ (FIG. 3). The electrical connector 104 may include a plurality of lead frames 170 that each has a plurality of the electrical contacts 134. Only one such lead frame 170 is shown in FIG. 4. Each of the electrical contacts 134 includes one of the mating portions 156, one of the contact tails 152, and a corresponding body portion 172 that extends between the mating portion 156 and the contact tail 152. The electrical contacts 134 of one lead frame 170 may reside in a single contact plane, such as the contact plane $P_1$ (FIG. 3). However, in some embodiments, the electrical contacts 134 of a lead frame may not reside in a single contact plane. The plurality of lead frames 170 may be spaced apart from each other along the width $D_2$ (FIG. 2) of the connector housing 114.

Optionally, the connector housing 114 may include one or more mounting projections 174. The mounting projection 174 may be integrally formed with the connector housing 114. For instance, the mounting projection 174 and the other features of the connector housing 114 may be formed from a common mold such that a continuous piece of material is produced. In other embodiments, the mounting projection 174 is fastened to the mounting side 120.

The mounting projection 174 may be located between the contact tails 152 and the mating side 112. More specifically, the conductor paths 160 of the body portions 172 of the electrical contacts 134 may extend through the connector housing 114 such that the electrical contacts 134 clear the mounting projection 174 and the contact tails 152 project from the mounting side 120 at locations that are closer to the back side 116 than the mounting projection 174. More specifically, the contact tails 152 are located between the mounting projection 174 and the back side 116.

As shown, the cavity 136 extends completely through the connector housing 114 from the mating side 112 to the back side 116. The mounting projection 174 is also located in the mating region 140. In particular embodiments, a common volume of space (e.g., the mating region 140) may include the cavity 136, the entire array 162 (FIG. 3) of the electrical contacts 134, and the mounting projection 174. Each of the mounting projection 174 and each of the electrical contacts 134 may be aligned with the cavity 136.

Figure 6:
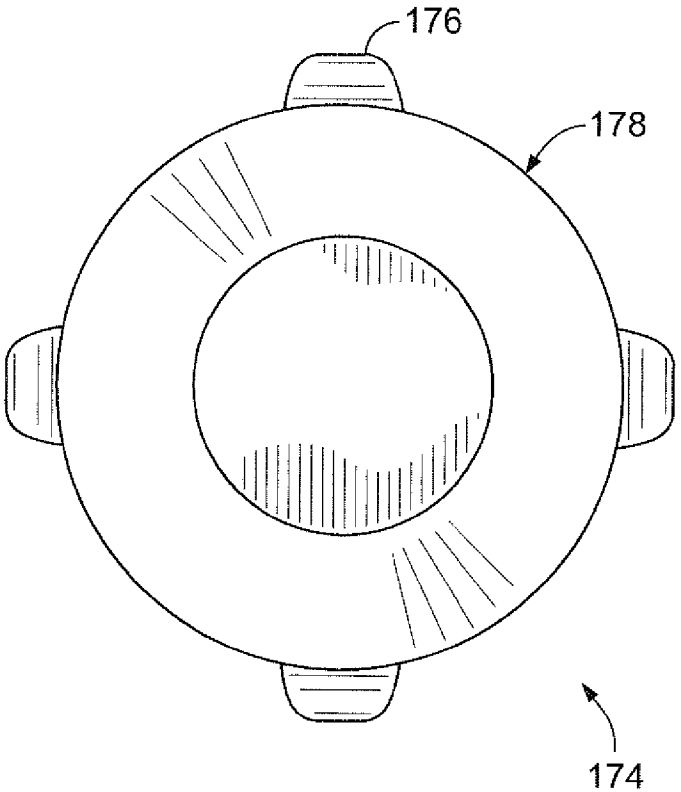
FIG. 6 is an end view of the mounting projection that may be used by the electrical connector of FIG. 1.
Figure 5:
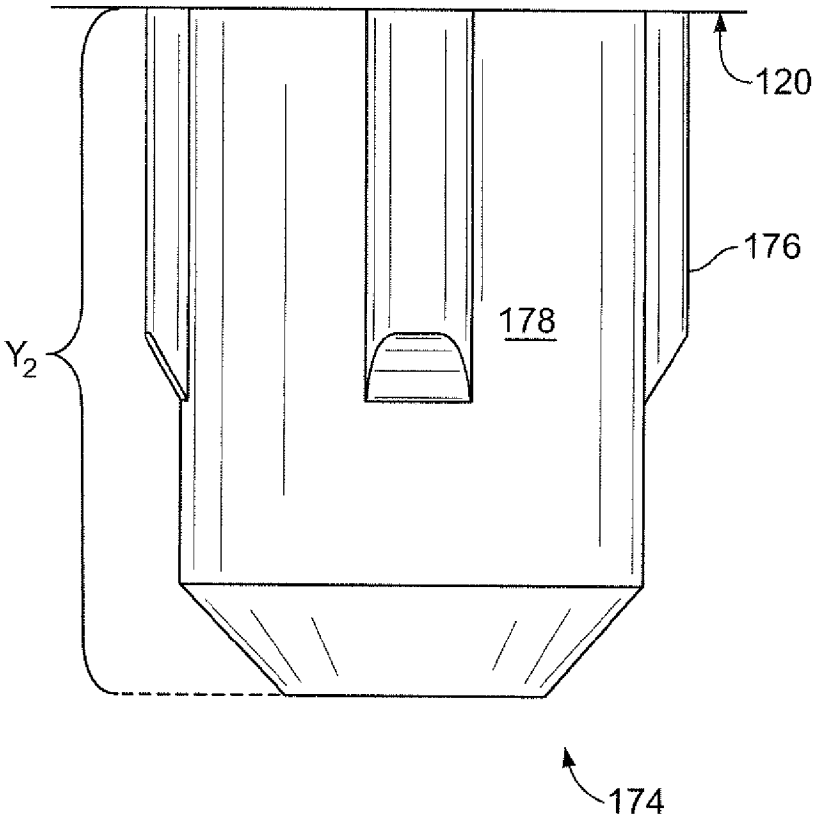
FIG. 5 is a side view of a mounting projection that may be used by the electrical connector of FIG. 1.

FIG. 5 is a side view of a mounting projection 174, and FIG. 6 is an end view of the mounting projection 174. The mounting projection 174 may project a distance $Y_2$ away from the mounting side 120 as shown in FIG. 5, and have a substantially circular profile as shown in FIG. 6. The mounting projection 174 may also include radially-protruding rib extensions 176. The rib extensions 176 project radially outward from an exterior surface 178 of the mounting projection 174. The mounting projection 174 is configured to be directly inserted into a hole or bore (not shown) of the circuit board 102 (FIG. 1). The rib extensions 176 are dimensioned to interfere with a wall of the hole such that the mounting projection 174 has an interference fit with the hole. As such, the mounting projection 174 may facilitate securing the electrical connector 104 (FIG. 1) to the circuit board 102. In particular embodiments, the electrical connector 104 does not require additional hardware (e.g., screws or other fasteners) for securing the electrical connector to the circuit board 102.

FIG. 7 is an isolated perspective view of the electrical connector 204. The electrical connector 204 is complementary to the electrical connector 104 (FIG. 1). For example, the electrical connector 204 may have openings or cavities to receive elements of the electrical connector 104 and may have structural features (e.g., projections) that are received by the openings and cavities of the electrical connector 104. In other words, the electrical connectors 104, 204 may be dimensioned to mate with each other to establish a mechanical or physical engagement in addition to an electrical connection.

As such, the electrical connector 204 may have a similar but complementary arrangement of electrical contacts, cavities, structural features, and the like with respect to the electrical connector 104. For example, the electrical connector 204 may have a connector housing 214 that includes opposite mating and back sides 212, 216, opposite top and mounting sides 218, 220, and opposite end sides 222, 224. The mating side 212 extends along a lateral axis 292 and may face in a mating direction $M_3$ along the engagement axis 291 during the mating operation. The mounting side 220 faces in a mounting direction $M_4$ along an orientation axis 293 and is configured to be mounted to a circuit board (not shown). Optionally, the mounting side 220 may include a mounting projection 274 that is configured to be received by a hole or bore (not shown) of the circuit board. The mounting projection 274 may be shaped similarly to the mounting projection 174 (FIG. 4).

Similar to the connector housing 114 (FIG. 2), the connector housing 214 includes first and second mating regions 240, 242 and a center region 244 that extends between the mating regions 240, 242 along the lateral axis 292. The mating regions 240, 242 may be defined by the end sides 222, 224, respectively. The electrical connector 204 may also include electrical contacts 232 and electrical contacts 234 that are coupled to the connector housing 214. In FIG. 7, the electrical contacts 232 are disposed within corresponding socket cavities 280, and the electrical contacts 234 are disposed within socket cavities 282. The socket cavities 280, 282 may be sized and shaped to receive the electrical contacts 132, 134, respectively (FIG. 2). In the illustrated embodiment, the electrical contacts 232 are in the center region 244 and the electrical contacts 234 are in the mating regions 240, 242.

The electrical connector 204 may also include first and second guide features 236, 238. In FIG. 7, the guide features are projections that are sized and shaped to be received by the cavities 136, 138, respectively (FIG. 2). As such, the guide features will hereinafter be referred to as guide projections 236, 238. The guide projections 236, 238 extend along an engagement axis 291 and have partially rounded or dome-shaped ends. The guide projections 236, 238 are located in the mating regions 240, 242, respectively. Like the electrical connector 104, at least some of the electrical contacts 234 of the mating region 240 are located between the guide projection 236 and the mounting side 220 and at least some of the electrical contacts 234 of the mating region 242 are located between the guide projection 238 and the mounting side 220.

In some embodiments, the electrical contacts 234 and the electrical contacts 232 have similar spatial relationships relative to each other and to the guide projections 236, 238 as the electrical contacts 134 and the electrical contacts 132 have relative to each other and to the cavities 136, 138. For example, the mating region 240 may include an entire array 262 of the electrical contacts 234, the guide projection 236, and one of the mounting projections 274. The mating region 242 may also include an entire array (not shown) of the electrical contacts 234, one of the guide projections 236, and one of the mounting projections 274.

The center region 244 may include a slot 230 that is sized and shaped to receive the interior wall 130 (FIG. 2). During the mating operation, the following may occur: (a) the electrical contacts 132 are inserted into the socket cavities 280 and engage the electrical contacts 232; (b) the electrical contacts 134 are inserted into the socket cavities 282 and engage the electrical contacts 234; (c) the interior wall 130 is inserted into the slot 230; and (d) the guide projections 236, 238 are inserted into the cavities 136, 138, respectively.

Figure 8:
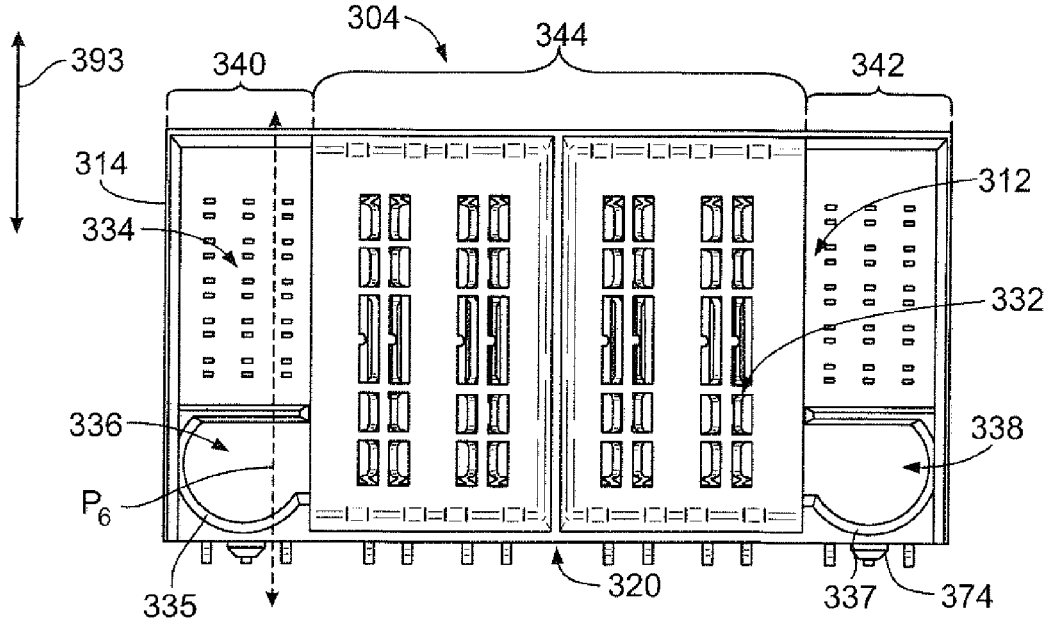
FIG. 8 is a front-end view of an electrical connector formed in accordance with one embodiment.
Figure 9:
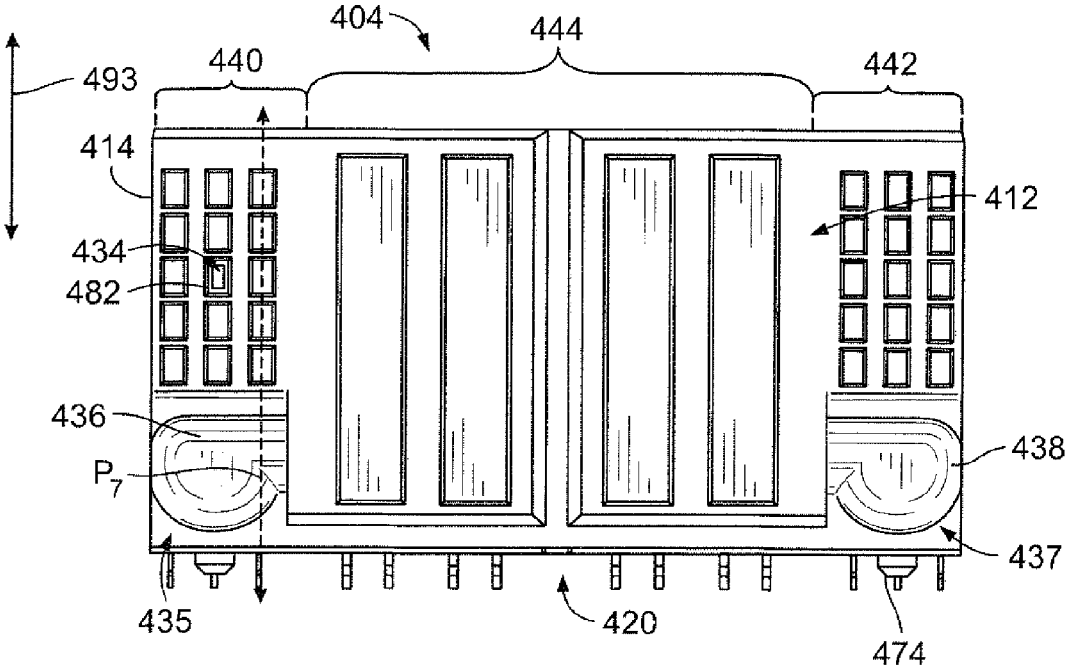
FIG. 9 is a front-end view of an electrical connector formed in accordance with one embodiment.

FIGS. 8 and 9 illustrate embodiments in which the electrical contacts are located between the guide feature and the top side. In particular, FIGS. 8 and 9 illustrate front-end views of mating sides 312, 412 of electrical connectors 304, 404, respectively. With respect to FIG. 8, the electrical connector 304 is similar to the electrical connector 104 (FIG. 1), but the guide feature and the electrical contacts may be arranged differently with respect to each other. For example, the electrical connector 304 has a connector housing 314 with a mounting side 320 that is configured to be mounted to a circuit board (not shown). The electrical connector 304 includes first and second mating regions 340, 342 and a center region 344 that extends between the first and second mating regions 340, 342. Electrical contacts 332 of the electrical connector 304 are disposed along the mating side 312 within the center region 344. Electrical contacts 334 are disposed along the mating side 312 within the first and second mating regions 340, 342. Also shown, the electrical connector 304 may include mounting projections 374 that project from a mounting side 320 of the electrical connector 304.

In the illustrated embodiment, the mating regions 340, 342 have guide features 335, 337, respectively. The guide features 335, 337 include cavities 336, 338, respectively. At least some of the electrical contacts 334 may be aligned with the corresponding cavity. For example, the cavity 336 and the electrical contacts 334 of the first mating region 340 are aligned with one another along an orientation axis 393. More specifically, a contact plane $P_6$ that extends parallel to the orientation axis 393 may extend through at least a plurality of the electrical contacts 334 and intersect the cavity 336. The cavity 336 is located between the electrical contacts 334 of the first mating region 340 and the mounting side 320.

With respect to FIG. 9, the electrical connector 404 is similar to the electrical connector 204 (FIG. 7). The electrical connector 404 is configured to engage the electrical connector 304 (FIG. 8) during a mating operation. As shown, the electrical connector 404 has a mounting side 420 that is configured to be mounted to a circuit board (not shown). The electrical connector 404 includes first and second mating regions 440, 442 and a center region 444 that extends therebetween. Electrical contacts 434 are disposed along the mating side 412 within socket cavities 482 of the first and second mating regions 440, 442. Also shown, the electrical connector 404 may include mounting projections 474 that project from a mounting side 420 of the electrical connector 404.

In the illustrated embodiment, the mating regions 440, 442 have guide features 435, 437, respectively, that include guide projections 436, 438, respectively. At least some of the electrical contacts 434 may be aligned with the corresponding guide projection. For example, the guide projection 436 and the electrical contacts 434 of the first mating region 440 are aligned with one another along an orientation axis 493. More specifically, a contact plane $P_7$ that extends parallel to the orientation axis 493 may extend through at least a plurality of the electrical contacts 434 and intersect the guide projection 436. The guide projection 436 is located between the electrical contacts 434 of the first mating region 440 and the mounting side 420.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector:

a connector housing positioned with respect to an engagement axis, a lateral axis, and an orientation axis that are mutually perpendicular with one another, the connector housing including:

a mating side facing in a mating direction along the engagement axis and configured to engage an electrical component during a mating operation, the mating side extending along the lateral axis and the orientation axis;

first and second end sides facing in opposite directions along the lateral axis; and a top side facing in a direction along the orientation axis, the top side extending between the first and second end sides and being substantially planar from the first end side to the second end side; and first and second mating regions, the first and second mating regions being defined by the first and second end sides, respectively, each of the first and second mating regions including:

electrical contacts and a guide feature that are disposed along the mating side and configured to engage the electrical component, wherein at least some of the electrical contacts and the guide feature are aligned with one another along the orientation axis.

2. The electrical connector of claim 1, wherein the connector housing includes a mounting side that is opposite the top side, the electrical contacts of the first mating region forming a first array, wherein (i) the first array is located between the guide feature and the mounting side or (ii) the guide feature is located between the first array and the mounting side.

3. The electrical connector of claim 2, wherein the mounting side includes a mounting projection that projects from the mounting side and is configured to engage a circuit board, wherein at least some of the electrical contacts of the first array and the mounting projection are aligned with one another along the orientation axis.

4. The electrical connector of claim 1, wherein the at least some electrical contacts of the first mating region are arranged in two columns of electrical contacts in which the columns extend along the orientation axis.

5. The electrical connector of claim 1, wherein the connector housing includes a mounting side that is opposite the top side, the mounting side including a mounting projection that projects from the mounting side and is configured to engage a circuit board.

6. The electrical connector of claim 1, wherein the guide feature is one of a guide module having a cavity or a guide projection.

7. The electrical connector of claim 1, wherein the connector housing includes a mounting side that is opposite the top side, the mounting side including a mounting projection, the electrical contacts of the first mating region including contact tails projecting from the mounting side, the mounting projection being located between the contact tails and the mating side.

8. The electrical connector of claim 6, wherein the mounting projection is substantially aligned with the guide feature along the orientation axis.

9. The electrical connector of claim 1, further comprising a circuit board, the circuit board having a leading edge and a board surface that extends to the leading edge, the electrical connector being mounted along the board surface.

10. The electrical connector of claim 1, wherein the connector housing includes a mounting side that is opposite the top side, wherein the top side, the mounting side, and the end sides define a perimeter of the mating side, the perimeter being rectangular.

11. An electrical connector:

a connector housing positioned with respect to an engagement axis, a lateral axis, and an orientation axis that are mutually perpendicular with one another, the connector housing including:

a mating side facing in a mating direction along the engagement axis and configured to engage an electrical component during a mating operation, the mating side extending along the lateral axis and the orientation axis;

first and second end sides facing in opposite directions along the lateral axis;

a top side facing in a direction along the orientation axis; and a mounting side that is opposite the top side; and first and second mating regions, the first and second mating regions being defined by the first and second end sides, respectively, each of the first and second mating regions including:

electrical contacts and a guide feature that are disposed along the mating side and configured to engage the electrical component, wherein at least some of the electrical contacts and the guide feature are aligned with one another along the orientation axis;

wherein the electrical contacts of the first mating region form a first array, wherein (i) the first array is located between the guide feature and the mounting side or (ii) the guide feature is located between the first array and the mounting side.

12. The electrical connector of claim 11, wherein the mounting side includes a mounting projection that projects from the mounting side and is configured to engage a circuit board, wherein at least some of the electrical contacts of the first array and the mounting projection are aligned with one another along the orientation axis.

13. The electrical connector of claim 11, wherein the at least some electrical contacts of the first mating region are arranged in two columns of electrical contacts in which the columns extend along the orientation axis.

14. The electrical connector of claim 11, wherein the mounting side includes a mounting projection that projects from the mounting side and is configured to engage a circuit board.

15. The electrical connector of claim 11, wherein the guide feature is one of a guide module having a cavity or a guide projection.

16. The electrical connector of claim 11, wherein the mounting side includes a mounting projection, the electrical contacts of the first mating region including contact tails projecting from the mounting side, the mounting projection being located between the contact tails and the mating side.

17. The electrical connector of claim 16, wherein the mounting projection is substantially aligned with the guide feature along the orientation axis.

18. The electrical connector of claim 11, further comprising a circuit board, the circuit board having a leading edge and a board surface that extends to the leading edge, the electrical connector being mounted along the board surface.

19. The electrical connector of claim 11, wherein the top side, the mounting side, and the end sides define a perimeter of the mating side, the perimeter being rectangular.

20. The electrical connector of claim 11, wherein the electrical contacts of the first array are signal contacts that are dimensioned to transmit data signals.

* * * * *